US005548914A

United States Patent [19]

Anderson

[11] Patent Number: 5,548,914

[45] Date of Patent: Aug. 27, 1996

[54] GUN TRIGGER MECHANISM

[76] Inventor: David B. Anderson, 40725 Brook Trails Way, Lake Riverside Estates, Aguanga, Calif. 92536

[21] Appl. No.: 337,931

[22] Filed: Nov. 10, 1994

[51] Int. Cl.[6] ..... F41A 19/06

[52] U.S. Cl. ..... 42/66; 42/65; 42/69.01

[58] Field of Search ..... 42/41, 65, 66, 42/69.01

[56] References Cited

U.S. PATENT DOCUMENTS

| | | | |
|---|---|---|---|
| 109,514 | 11/1870 | Hay . | |
| 172,400 | 1/1876 | Duffie . | |
| 566,393 | 8/1896 | Fyrberg | 42/66 |
| 600,337 | 3/1898 | Richardson | 42/66 |
| 793,692 | 7/1905 | Tansley | 42/66 |
| 935,102 | 9/1909 | Fyrberg | 42/66 |
| 945,320 | 1/1910 | Fyrberg | 42/66 |
| 1,256,631 | 2/1918 | Zeymer . | |
| 2,470,259 | 2/1949 | Norman et al. | 42/66 |
| 3,748,771 | 7/1973 | Piscetta | 42/66 |
| 3,773,384 | 12/1973 | Ruger et al. . | |
| 3,777,384 | 12/1973 | Ruger et al. | 42/65 |
| 3,972,142 | 8/1976 | Kawamura | 42/41 |
| 3,988,848 | 11/1977 | Chatigny | 42/66 |
| 4,011,678 | 3/1977 | Brodbeck et al. . | |
| 4,016,668 | 4/1977 | Frazier | 42/41 |
| 4,028,835 | 6/1977 | Canjar | 42/69.01 |
| 4,128,957 | 12/1978 | Lee | 42/65 |
| 4,143,636 | 3/1979 | Liepins et al. . | |
| 4,218,839 | 8/1980 | Brouthers | 42/65 |
| 4,282,795 | 8/1981 | Beretta . | |
| 4,313,274 | 2/1982 | Ludwig et al. . | |
| 4,352,317 | 11/1982 | Wilhelm . | |
| 4,841,840 | 6/1989 | Agner et al. . | |
| 4,854,065 | 8/1989 | French et al. | 42/65 |
| 4,866,869 | 9/1989 | Mainland . | |
| 4,962,606 | 10/1990 | Pozzi | 42/66 |
| 5,012,604 | 5/1991 | Rogers | 42/69.01 |
| 5,067,266 | 11/1991 | Findlay . | |
| 5,259,138 | 11/1993 | Scirica . | |

FOREIGN PATENT DOCUMENTS

| | | | |
|---|---|---|---|
| 2586796 | 3/1987 | France | 42/66 |
| 1923395 | 11/1970 | Germany | 42/66 |

*Primary Examiner*—Michael J. Carone
*Assistant Examiner*—Theresa M. Wesson
*Attorney, Agent, or Firm*—Lyon & Lyon

[57] ABSTRACT

A gun trigger mechanism that helps prevent accidental discharge of a gun, including a spring-loaded hammer retainable in a fully-cocked position, from which it may be fired, or a half-cocked position, at which it may be loaded and unloaded, but not fired, by engagement between a trigger sear and a hammer sear or a half-cocked notch, respectively, preferably including an interlock, hidden within the gun's frame, a trigger spring biasing the interlock towards a locked position, where it provides a blocking interface between the hammer and the gun's frame. A hammer blocking arm, on the interlock swinging end, rides generally between and against two frame shoulders when the hammer is near a firing position and the trigger is not being pulled. The hammer blocking arm and the swinging end of the interlock are moved down and forward, away from the frame shoulders when the trigger is pulled. A hammer shoulder mounted on a lower end of the hammer must move toward and between the frame shoulders for the hammer to reach the firing position. Unless the trigger is pulled, the gun cannot be fired. As the hammer is biased to an at-rest position, away from the firing position, the interlock is biased upward to its locking position. In its normal, uncocked state, the hammer cannot be fired by accidental bumping of the hammer. Alternatively, it is also preferable that removal of the hidden interlock prevents safe and normal operation of the trigger.

32 Claims, 7 Drawing Sheets

GUN TRIGGER MECHANISM

BACKGROUND

The present invention relates to a gun trigger mechanism. More particularly, it provides a safety mechanism that helps prevent accidental discharge when the gun is being handled.

BACKGROUND OF THE INVENTION

As with other products, such as stamps, cars and china, collectors frequently seek working editions of original, historic guns that were once popular. Unfortunately, as with these other products, original models may be in limited supply, or their condition may have degenerated substantially due to extensive usage or passage of time. To meet this limited supply, replicas of original guns are often desired to closely duplicate the appearance of the original product. A significant advantage of the replicas is that, aided by modern technology, they are mint-condition replications of the original gun models.

During their original design, many guns lacked the advantage of present technology, and some are relatively dangerous to handle, as they lack adequate safety mechanisms that ensure that the gun will not be accidentally discharged during handling. Such safety mechanisms typically cannot be added to the original gun or replica, because to be valuable, the gun must look and feel exactly like the original product. Retrofitting the original design often will change its external appearance, hence make the gun less valuable.

Historically, many guns were single-action, which is to say that in order for the gun to be fired, a hammer on the gun had to first be manually cocked, or rotated back to a spring-loaded position, and then subsequently released by pulling the trigger of the gun. Some guns had a safety mechanism to help ensure that the gun would not be accidentally fired. For example, in many single-action revolvers, the gun would be half-cocked so that it could be loaded, but in this position, the hammer could not be released by pulling the trigger, a design feature intended to avoid accidental discharge.

Unfortunately, whether in this partially-cocked position, or in a fully-cocked position, many guns of this design are dangerous to handle, because dropping or jarring of the gun can cause the accidental release of the hammer and cause the gun to be discharged. That is to say, the trigger and safety mechanisms of these guns are not very reliable, and can be worn by usage, rendering the operation of the trigger mechanism increasingly unreliable with age. The dangerousness of these mechanisms is typically not lessened in present day use of originals or authentic reproductions, since the focus of these devices is upon their original construction and appearance, and they tend to operate exactly like the originals.

A typical single-action revolver 11 is illustrated in FIG. 1, which is an exploded isometric view of the revolver in a disassembled state. A hammer 13 is mounted to rotate about a pivot point 15, formed by a pin 17 held by a frame of the gun. The frame actually is made up of several parts that are rigidly connected together, including a cylinder-housing 19, a grip 21 and a backstrap 22. A hammer spring 23 lies between the hammer 13 and the grip 21 to urge the hammer to rotate about the pivot point 15 towards the cylinder-housing 19. The particular type of gun seen in FIG. 1 is a six-shooter, and it has a cylinder 25 that can be rotated to sequentially align six chambers 29 with a gun barrel 31 and a firing pin 27, which is mounted on an end of the hammer for firing. Each time the hammer 13 is pivoted back, the cylinder 25 is rotated by a pawl 30 to move a subsequent chamber in-line with the firing pin 27. As the hammer 13 is further pivoted back, the cylinder 25 is stopped from rotating by a cylinder latch 33 which engages one of six notches 34 in the circular periphery of the cylinder, one notch for each chamber 29. At this point, the hammer 13 is fully-cocked, a chamber aligned with both the firing pin 27 and the gun barrel 31, and the hammer is ready to be released.

In the revolver 11 illustrated in FIGS. 1 and 2, the hammer 13 has an arcuate bottom edge that forms a cam 35. This cam 35 has an firing position notch 36, a half-cocked notch 37 and a hammer sear 39. This construction respectfully defines three positions of the hammer 13, including: (a) a firing position, where the hammer lies directly in contact with an inner shoulder 26 of the cylinder-housing and the firing pin 27 penetrates the cylinder-housing to just reach a chamber of the cylinder 25; (b) a half-cocked position, in which the cylinder is not locked, and may be rotated for loading or unloading, but in which the trigger may not be pulled; and (c) a fully-cocked position, in which the gun may be fired by pulling a trigger 45.

As the hammer 13 is pivoted to move the firing pin 27 away from the cylinder-housing 19, a trigger sear 43, formed by a top end of the trigger 45, is urged by a leaf-spring 47 against the cam 35. As the hammer 13 is moved back, i.e., "cocked" the trigger sear 43 is urged to engage each of the hammer's notches and sear 36, 37 and 39 in turn. The half-cocked notch 37, as seen best in FIG. 2, actually forms a recess in the hammer that can be used to retain the trigger sear 43. The trigger 45 is pivotally mounted, and the leaf-spring 47 urges the trigger to rotate counterclockwise to the maximum extent permitted by the cam 35. This increases slightly along the cam, and thus, as the hammer 13 is cocked, the trigger 45 moves its finger-portion 46 forward under the influence of the leaf-spring 47, as indicated by the arrow 51 (seen in FIG. 2). The trigger sear 43 will slide over the half-cocked notch 37 as the gun is being cocked, and if desired, the hammer can be slid back into this half-cocked position, where the recess of the hammer notch and the trigger engage each other and lock the trigger sear to the hammer, such that the trigger 45 cannot be pulled. In this position, the cylinder 25 may be rotated and the gun may be loaded and unloaded.

As the hammer is further moved to a fully-cocked position, the hammer sear 39 engages the trigger sear 43 to hold the hammer in this position. However, since there is no recess of the hammer sear 39, pulling of the trigger 45 can readily disengage the hammer 13 and the trigger sear 43, causing the hammer to snap back toward the cylinder-housing 19 under the force of the spring 23.

As is clearly seen in FIG. 2, both of the half-cocked notch 37 and the hammer sear 39 are fairly narrow, and thus, it is possible for some jarring motion to cause the trigger sear 43 and the hammer 13 to disengage once they have engaged in the half-cocked or fully-cocked positions. This becomes more likely if the gun 11 has been heavily used, since each of the half-cocked notch 37, the hammer sear 39 and the trigger sear 43 can be worn by use. Failure of these mechanisms, or dropping or jarring the gun, can cause accidental discharge, which of course is very dangerous. In addition, when the gun is in its firing position, the firing pin 27 is directly adjacent to the cylinder 25 and aligned with one of its chambers 29. If the back of the hammer is struck sufficiently hard, this can also cause accidental discharge, even if the gun is not cocked.

In part to address these problems, various trigger mechanisms have been developed to prevent accidental discharge of the gun. One such approach, often employed in modern revolvers, is to use a transfer bar, which is a metal bar coupled to the pivoting trigger of the gun. The transfer bar actually has to be struck by the hammer, to "transfer" force to the firing pin and fire the gun. Unless the trigger is pulled, the transfer bar is not advanced to lie between the hammer and the firing chamber, and thus, accidental release of the trigger from a cocked position does not cause the gun to fire.

A disadvantage with this type of trigger mechanism and other safety mechanisms is that, if it is used in an original gun or a replica, the transfer bar or other mechanism is visible from the exterior of the gun, and thus detracts from the authentic appearance of the gun. Such a mechanism can also be impractical as part of a "kit" for retrofit of an existing gun, because substantial alterations to the cylinder-housing or grip of the gun may be required to incorporate this type of trigger mechanism. A transfer bar mechanism simply is not readily installed in many original guns, because the guns' design generally does not accommodate additional parts needed to implement a transfer bar, or externally operable safety mechanism.

Thus, what is needed is a gun trigger mechanism that reliably helps prevent accidental discharge. More particularly, what is needed is a gun trigger mechanism that can be used in a gun to block the hammer, until and unless the trigger is actually, concurrently being pulled by a human operator. Preferably, such a device should not rely exclusively upon engagement between the sears of the trigger and the hammer, or another mechanism that can be easily worn by age or use. Additionally, such a trigger mechanism should be adaptable to use in single-action guns, double-action guns, long guns, shotguns, derringers and other guns. It should best be hidden from view, and thus provide a safety mechanism for original guns and their replications that does not detract from their appearance, and hence their value. The present invention fulfills these needs, and provides further, related advantages.

SUMMARY OF THE INVENTION

The present invention provides a gun trigger mechanism that reliably prevents the hammer from reaching a firing position until and unless the trigger is being pulled. Thus, it provides a safety mechanism that substantially reduces the chance of accidental discharge. In addition, however, the gun trigger mechanism provided by the present invention utilizes parts which are entirely contained within the stock or handle and receiver or frame of the gun, keeping any non-authentic parts hidden from view and thus preserving the authentic appearance of the original gun edition or replica thereof. The mechanism is inexpensive to manufacture and can be easily retrofitted to an original gun edition by the incorporation of a few parts; hence its use is practical and is not limited to reproductions only. The present invention may be implemented in an existing gun, if desired, by means of a kit that assists in retrofitting the existing gun.

In accordance with the present invention, a gun trigger mechanism includes a gun frame, a gun trigger and a hammer that can be cocked by pivoting it to a fully-cocked position. In this position, it is ready to be fired by thereafter pulling the trigger. In addition, the mechanism includes an interlock that is moved between locked and unlocked states, to selectively block movement of the hammer to the firing position if the hammer is accidentally released. Pulling the trigger removes the interlock from the locked state, hence allowing the hammer to move to its firing position, where it can strike a cartridge.

In one aspect of the invention, the interlock is redundant to a firing mechanism, provided by interface between the trigger and the hammer. This firing mechanism includes a sear of the trigger and a sear of the hammer, which engage one another to both selectively retain the hammer in the fully-cocked position and permit its release when the trigger is pulled.

In still another aspect of the invention, the interlock is urged to lie next to a shoulder of the gun frame, and that it extends into the path of a hammer shoulder and provides a blocking mechanism should the two Sears accidentally disengage. Thus, if the gun is dropped or jarred, or if the trigger mechanism fails, the interlock will block the hammer's motion to the firing position to prevent discharge. The gun can include an at-rest position, which is not quite the firing position, and the interlock can be made to interpose itself between the frame and hammer shoulders at this point. Thus, in cooperation with the frame shoulder, the interlock provides a rigid block that keeps the firing pin away from a live cartridge until and unless the trigger is pulled, to thereby remove the blocking influence of the interlock. The hammer can be urged away from the firing position to the at-rest position by means of a resilient device, for example, a hammer strut.

In a different aspect of the invention, the gun trigger mechanism can include an interlock that has a wide arm to couple a trigger-biasing spring to the trigger. If the interlock is removed from the gun, the trigger is not spring-biased to engage the hammer and hold it in either a half- or fully-cocked position. Pursuant to this form of the invention, the trigger-biasing spring can be replaced with a modified spring, or the trigger replaced with a modified trigger, such the trigger is not biased by the spring unless the interlock is installed.

The invention may be better understood by referring to the following detailed description, which should be read in conjunction with the accompanying drawings. The detailed description of a particular preferred embodiment, set out below to enable one to build and use one particular implementation of the invention, is not intended to limit the enumerated claims, but to serve as a particular example thereof.

DETAILED DESCRIPTION

The invention summarized above and defined by the enumerated claims may be better understood by referring to the following detailed description, which should be read in conjunction with the accompanying drawings. This detailed description of a particular preferred embodiment, set out below to enable one to build and use one particular implementation of the invention, is not intended to limit the enumerated claims, but to serve as a particular example thereof. The particular example set out below is the preferred specific implementation of a gun trigger mechanism for a single-action revolver 101. The principles of the invention, however, are not limited to revolvers, and can apply to other types of guns as well, whether those guns are antiques or newer gun models.

I. Introduction To The Principal Parts.

Figure 10:
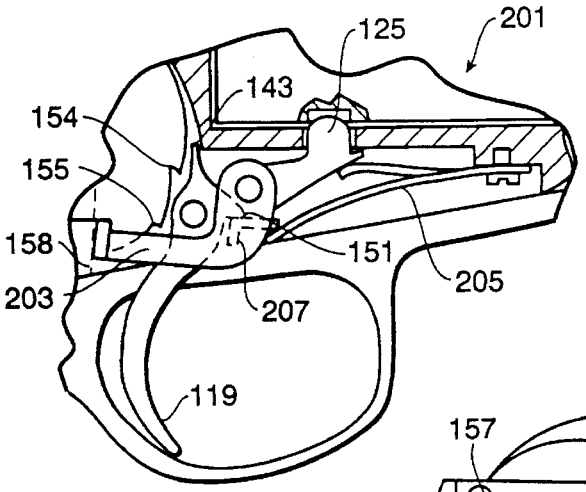
FIG. 10 is a cross-sectional side-view of the alternative gun trigger mechanism of FIG. 9.
Figure 9:
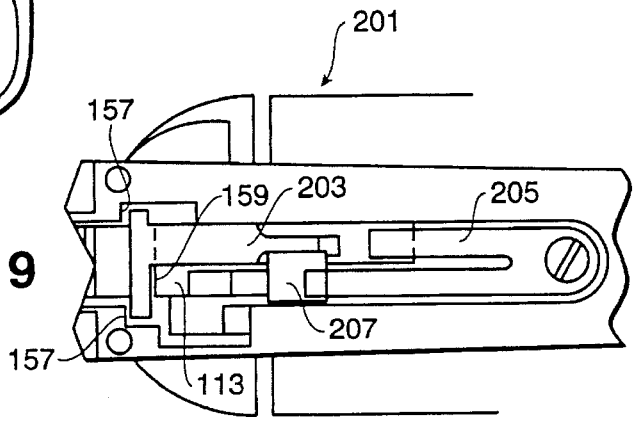
FIG. 9 is another cross-sectional bottom view, similar to that of FIG. 7, except that it shows the alternative gun trigger mechanism that corresponds to use of the spring of FIG. 8.
Figure 8:
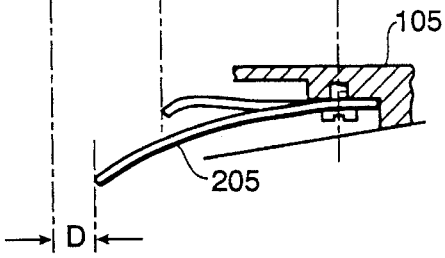
FIG. 8 is a view of a shortened leaf-spring that separately biases both of the trigger and a cylinder latch in an alternative embodiment, where the trigger will not function in a safe, proper manner if a modified interlock is removed.
Figure 11:
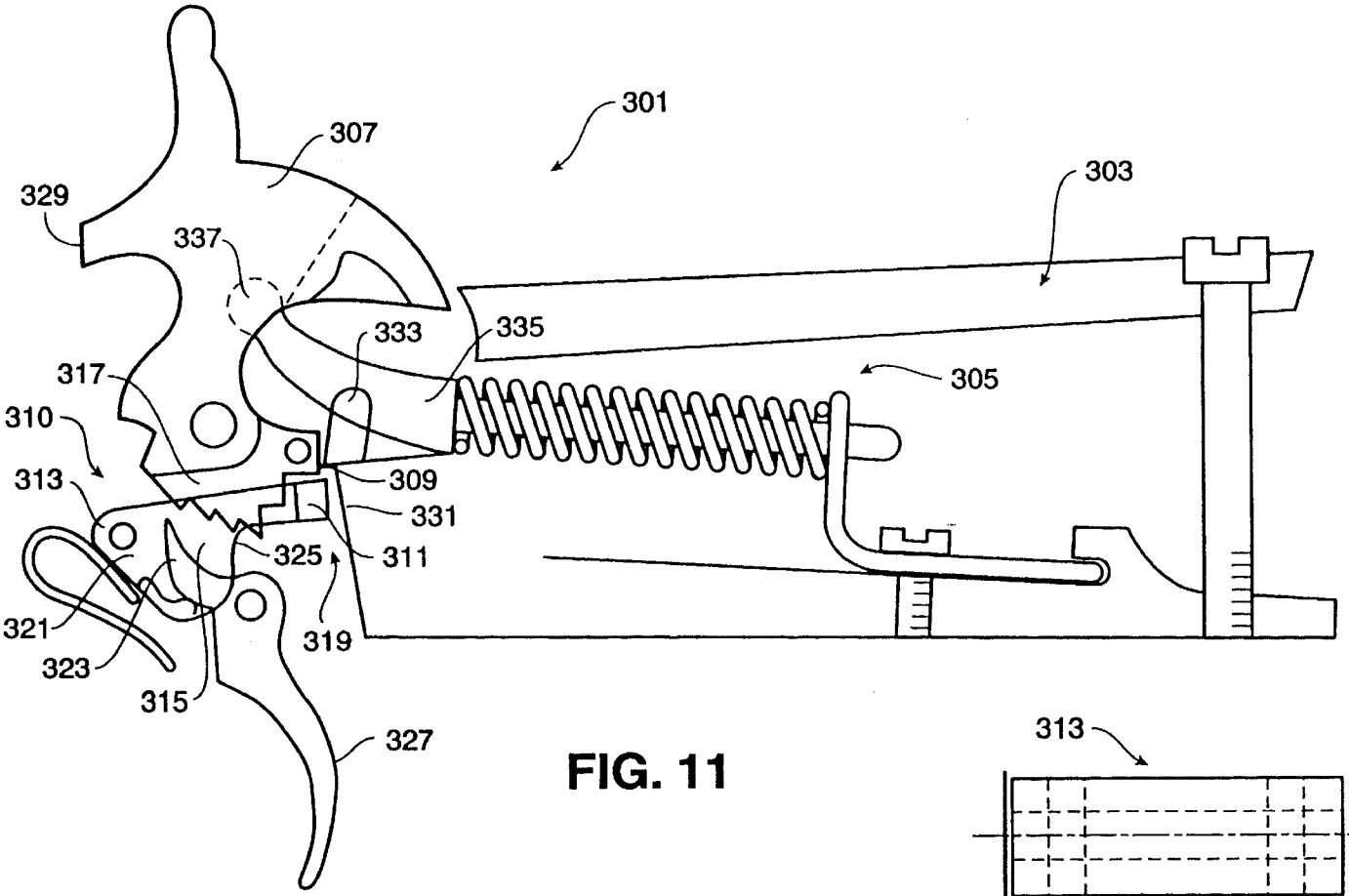
FIG. 11 is a cross-sectional view of a gun trigger mechanism, similar to FIG. 3, except that FIG. 11 shows a gun trigger mechanism implemented upon a gun having a stock, such as a long gun, rifle or shotgun.

The preferred gun trigger mechanism will be described with reference to accompanying FIGS. 3–7, which illustrate the mechanism's use and operation. FIGS. 8–10, by contrast, show an alternative gun trigger mechanism that does not operate in its normal, proper manner if a particular safety feature is removed from the device. Finally, FIG. 11 shows implementation of a gun trigger mechanism in a long gun, such as a rifle, shotgun, musket, or other gun.

Figure 1:
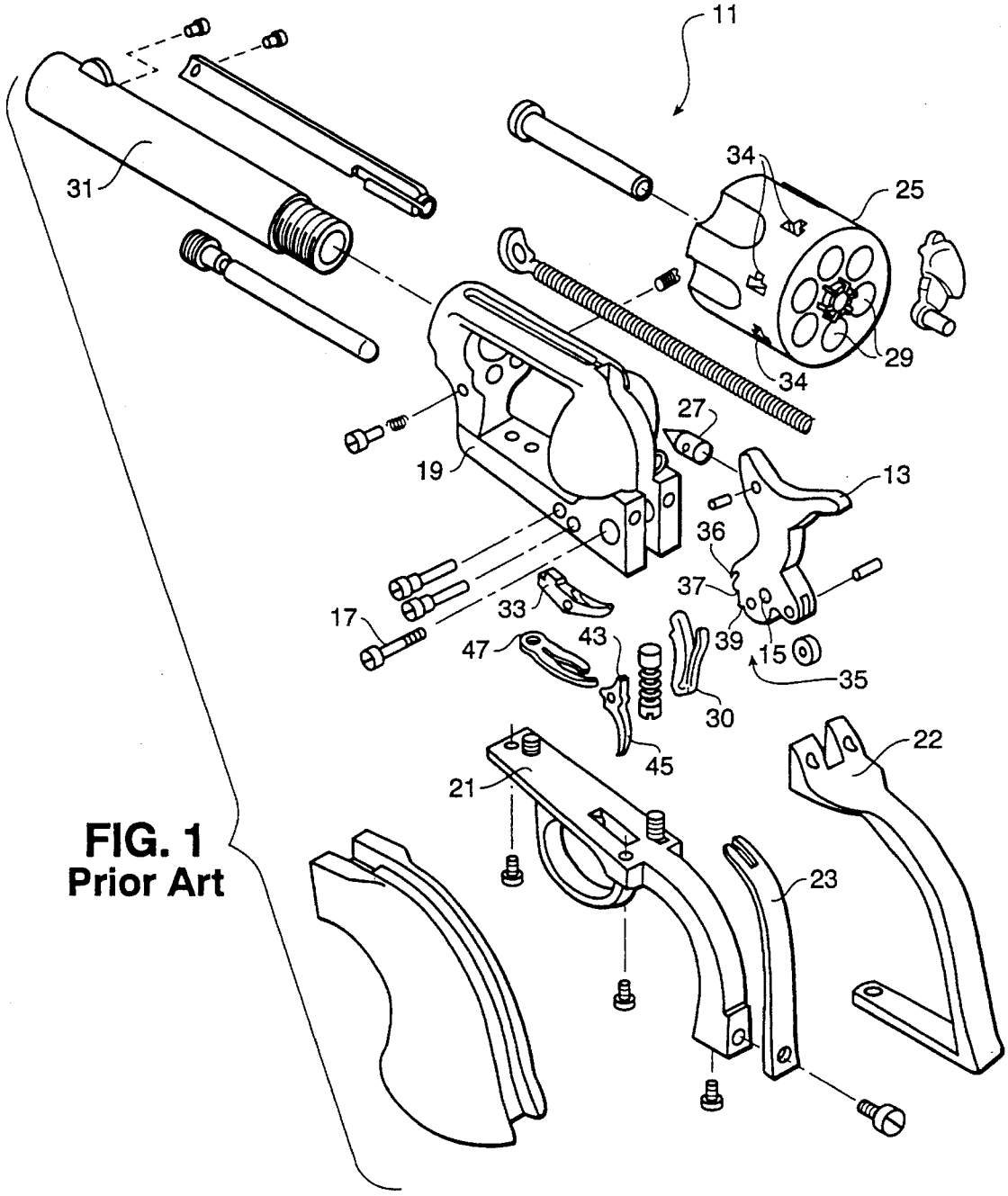
FIG. 1 Prior Art
FIG. 1 an isometric, exploded view of a prior art revolver, and illustrates the various parts of a revolver.
Figure 2:
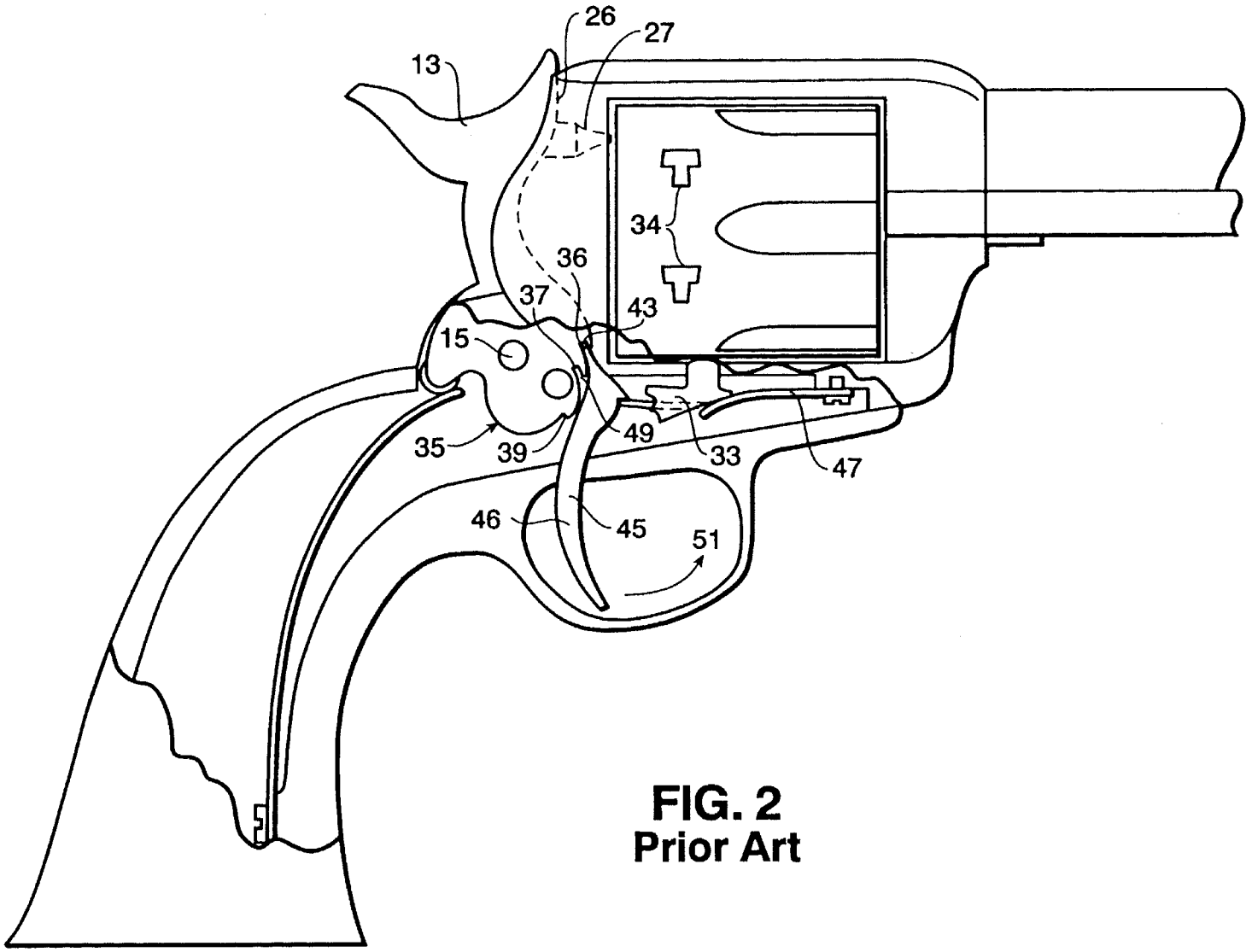
FIG. 2 Prior Art
FIG. 2 is a cut-away side view of the prior art revolver of FIG. 1, with a cylinder latch removed to help illustrate a trigger mechanism found in the prior art.
Figure 3:
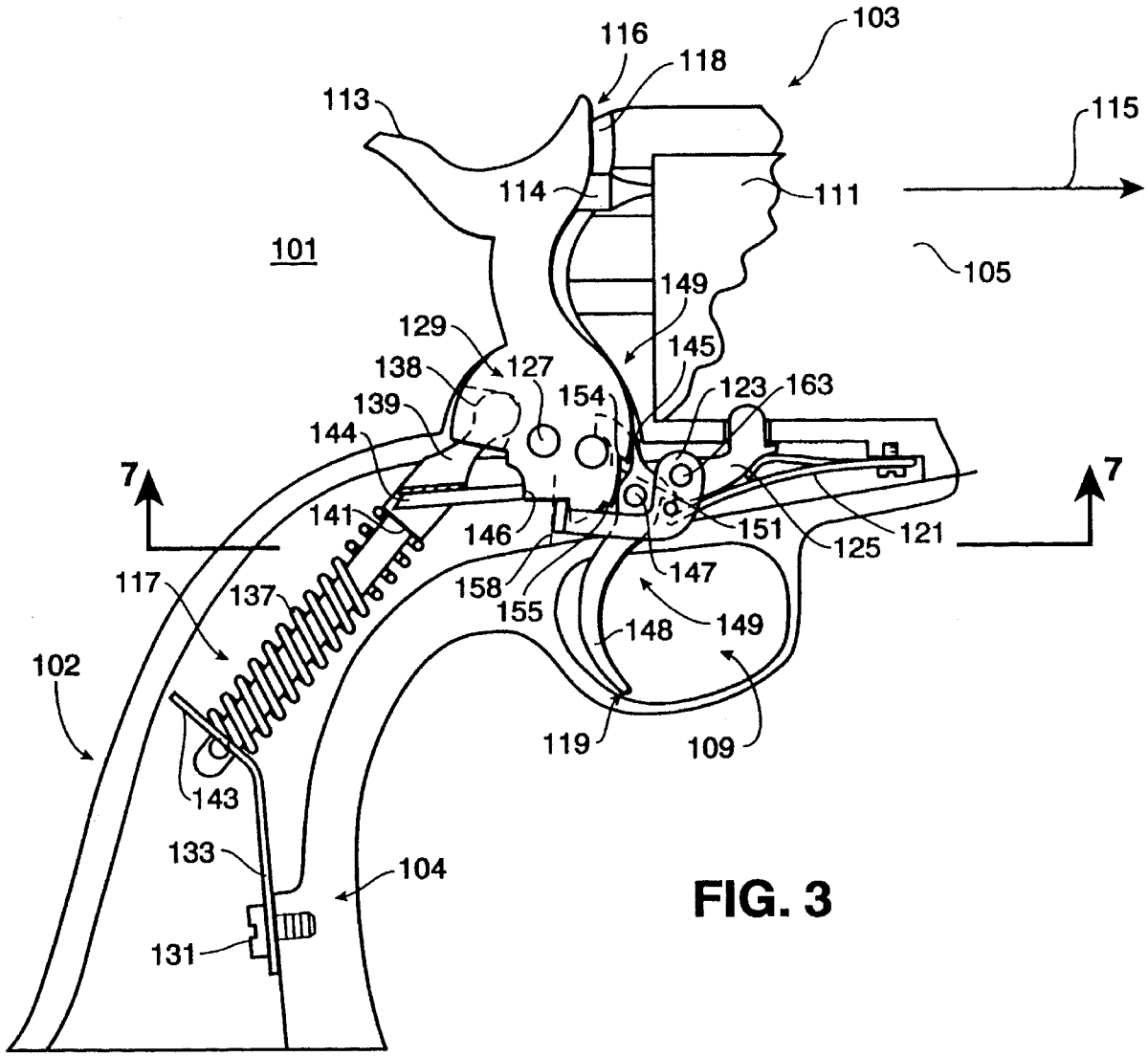
FIG. 3 is a cross-sectional side view of a single-action revolver having a preferred gun trigger mechanism that implements the present invention; the gun is shown in an at-rest state.
Figure 7:
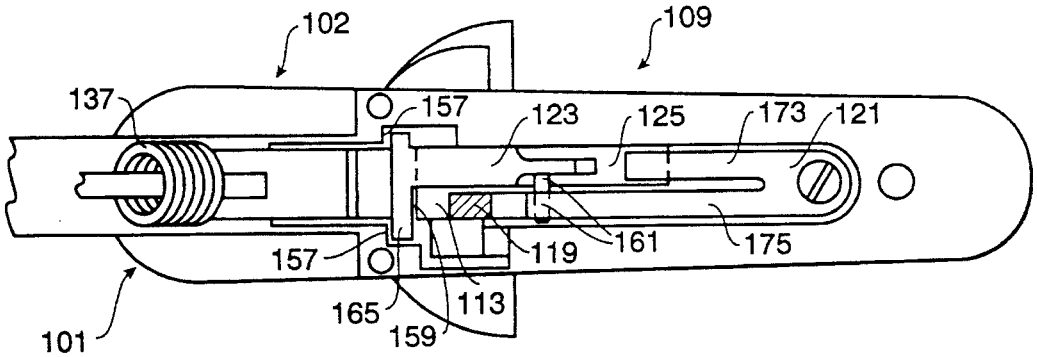
FIG. 7 is a cross-sectional bottom view of the gun trigger mechanism of FIG. 3, taken along lines 7—7 of FIG. 3.

The preferred gun trigger mechanism makes the revolver 101 a safer product to handle at all times. Unlike some other guns, a hammer 113 of the gun is held slightly away from the cartridge when the hammer is in an at-rest position, as seen in FIG. 3. In this position, a firing pin 114 of the gun is held outside of a cylinder window 111 where a cartridge would be located for firing; unless the cartridge is struck by the firing pin, the gun cannot be fired. In this position, an interlock 123 is pivoted to move a hammer arm 165 up between frame shoulders 157 and a hammer shoulder 159 (these shoulders are seen in FIG. 7, but fall on either side of the cross-section of FIGS. 3–5, and so are not seen in those figures). The hammer arm 165 extends perpendicularly into an out of the cross-section of FIG. 3, and provides a bridge that the hammer shoulder 159 must move through in order to bring the firing pin 114 into the cylinder window 111. This cannot happen when the interlock 123 is in the locked state, because the frame shoulders 157 and the hammer arm 165 cooperate to form a rigid stop and, accordingly, any hitting or bumping the back end of the hammer 113 cannot cause the gun to fire.

Figure 4:
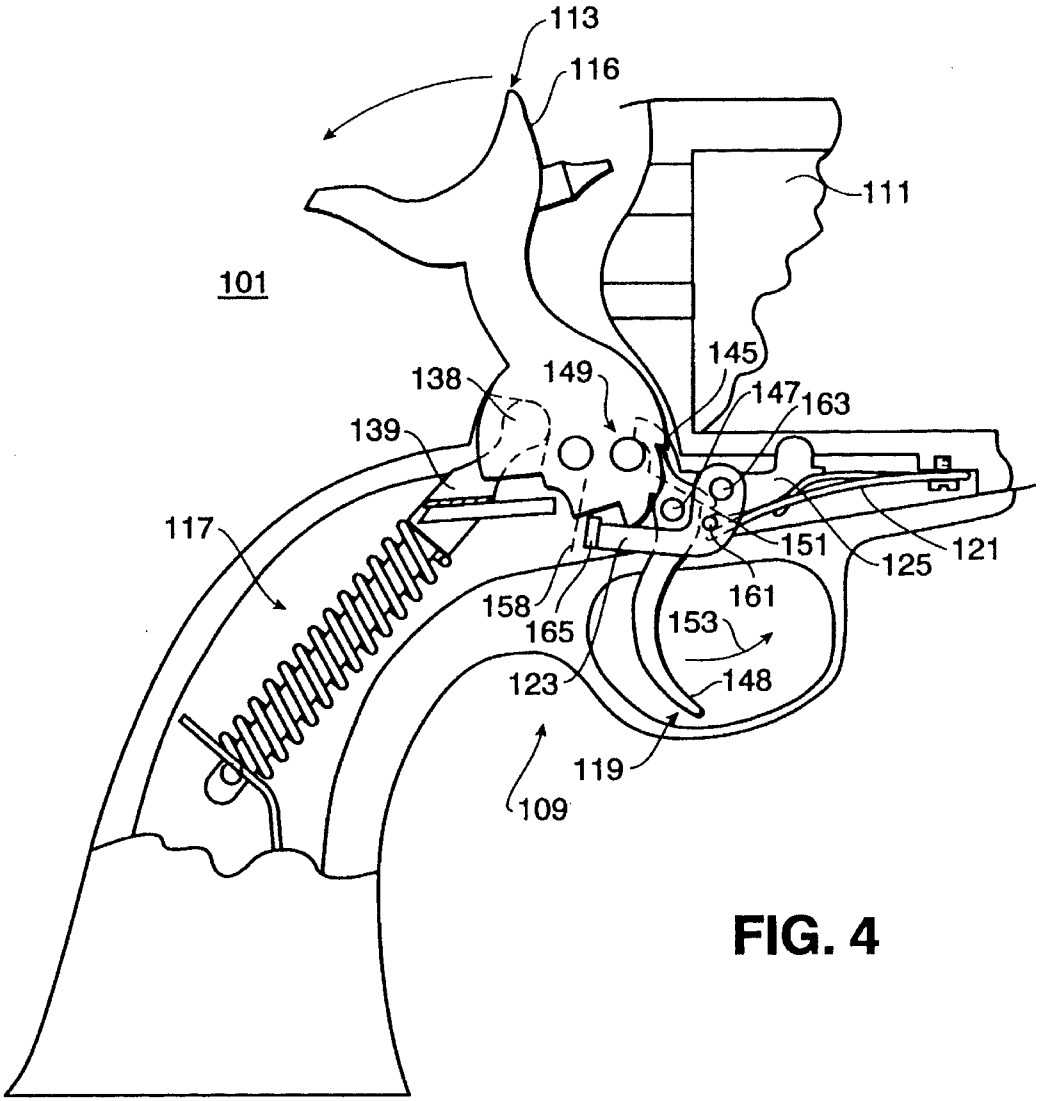
FIG. 4 is another view of the revolver of FIG. 3, but in which the hammer has been moved to a half-cocked position, in which the revolver may be loaded and unloaded.
Figure 5:
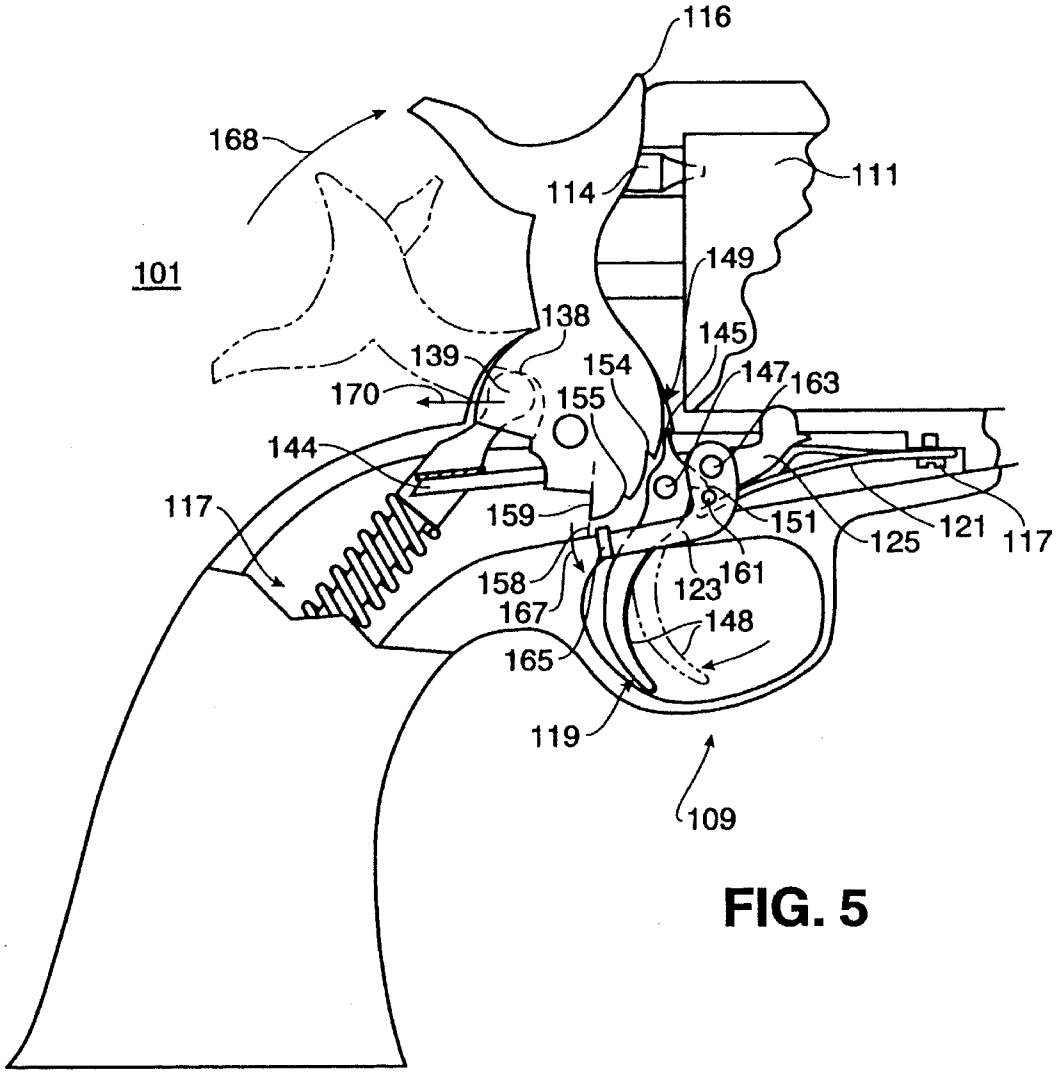
FIG. 5 is another view of the revolver of FIG. 3, but in which the hammer is being released from a fully-cocked position (phantom) and has moved past the at-rest position to the firing position.

The hammer 113 of the revolver 101 can be moved to a partially-cocked position (FIG. 4 shows a half-cocked position) or a fully-cocked position (indicated in phantom in FIG. 5), from which the gun is intended to be fired upon pulling the trigger. In these positions, as seen in FIGS. 4 and 5, the hammer arm 165 pivots down and forward of the frame shoulders 157 where it appears to not block movement of the hammer 113. FIG. 5 in particular, shows the revolver 101 in the process of being fired by pulling a trigger 119, and the interlock 123 is seen as being retained out of its locked state. However, it will be understood that the interlock 123 is pivoted back upward into its locking position of FIG. 3 as the hammer is released and moves forward toward its firing position, unless the trigger 119 is concurrently being pulled. Thus, if the hammer 113 is released by means other than by pulling the trigger 119, the hammer arm 165 will move back up and keep the gun from firing.

FIG. 5 shows in solid lines the firing position of the gun with the trigger 119 being pulled. In this position, the hammer 113 lies in abutting contact with a cylinder-housing 103 of the revolver and the firing pin 114 protrudes into the cylinder window 111 to strike a cartridge. A rigid hammer strut 144, in cooperation with a hammer biasing spring 137, urges the hammer 113 out of the firing position of FIG. 5 and back to the at-rest position, which is seen in FIG. 3.

The preferred revolver 101 has a number of basic elements, including generally a gun frame and a trigger mechanism. The gun frame actually is made up of several parts, including a backstrap 102, a cylinder-housing 103 and a grip 104. The backstrap 102 and the grip 104 are connected together by means of screws (not shown) and are used to form a handle of the revolver 101, by which the revolver 101 can be gripped and held by a human hand. The cylinder-housing 103 is connected to this handle, by screws which affix it atop the backstrap 102 and grip 104.

The gun frame mounts a trigger mechanism 109 which is used to fire the revolver 101. The hammer 113 is first pulled back against a powerful coil spring 137 and then suddenly released, to cause it to snap back toward the cylinder-housing 103. The trigger mechanism 109 is employed to keep the hammer in a cocked position in preparation for firing, until the gun is actually to be fired. In accordance with the present invention, the trigger mechanism 109 also prevents against accidental release of the hammer from firing the gun when the trigger 119 is not being pulled.

An alternative trigger mechanism 20L is seen in FIGS. 8–10. In this embodiment, an alternative interlock 203 is used in connection with a shortened leaf-spring 205. As can be seen by comparing FIG. 6 (spring of the preferred embodiment) with FIG. 8 (spring of this alternative embodiment), the shortened leaf-spring 205 is reduced in length by a distance "D" that normally causes the spring to fall short of a nose 151 of the trigger. The alternative interlock 203 otherwise functions in the same manner as does the preferred embodiment, except that removal of the alternative interlock prevents normal and proper operation of the trigger assembly.

Details of each of these two particular embodiments are elaborated upon below.

II. The Gun Frame And The Hammer 113.

FIG. 3 shows a cross-section of the preferred single-action revolver 101. As indicated above, the frame includes a backstrap 102, a cylinder-housing 103 and a grip 104 that are fastened together to form a rigid support for the gun.

The cylinder-housing 103 defines a cylinder window 111, into which a cylinder 105 is mounted to carry ammunition (cartridges) for firing. The cylinder 105 is a six-chamber cylinder that is rotated each time the hammer 113 is cocked, so as to thereby move a new cartridge into a firing line 115, where the firing pin 114 of the hammer can strike it. Advancement of the cylinder is accomplished by a spring-biased pawl, and it is stopped by a cylinder latch 125 from further rotation when the gun is either cocked or is in an at-rest position. When the hammer 113 is half-cocked, however, as seen in FIG. 4, the cylinder 105 may be rotated to load and unload the revolver 101.

To fire the revolver 101, its hammer 113 must first be moved from an at-rest position (FIG. 3) toward a fully-cocked position, seen in phantom in FIG. 5. From this fully-cocked position, the hammer may be selectively released and, as its firing pin 114 reaches a cartridge in the firing line 115, the hammer possesses enough momentum to cause firing. Since the preferred revolver 101 is a single-action gun, pulling the trigger 119 is ineffective to fire it unless the hammer 113 is first cocked. A double-action gun, by contrast, is effective to automatically both cock and release the hammer as the trigger is pulled.

The hammer 113 is pivotally mounted within the cylinder-housing 103 at a pivot point 127, and it is supported by a hammer spring assembly, generally identified by the reference numeral 117 in FIGS. 3–5. More particularly a hammer pivot screw or pin is rigidly mounted to the cylinder-housing 103 at this pivot point 127, and it permits the hammer 113 to rotate about the pin between the firing and fully-cocked positions. The hammer spring assembly 117 supports rotation of the hammer 113 and provides a bias to the hammer 113 to urge it back toward the cylinder-housing when the hammer has been cocked. The hammer spring assembly 117 includes a coil spring 137, which extends downward from a base 129 of the hammer toward the grip 104, and a spring guide 139, which has a ball on its upper end to interface with the hammer 113.

As seen in FIGS. 3–5 in phantom, this ball penetrates a receiving slot 138 in a rear-portion of the base of the hammer, which it rides in. The receiving slot 138 is effective to retain the spring guide 139 in contact with the hammer, and cooperates with the backstrap 102 to retain the hammer spring assembly 117 within the handle portion of the gun during firing. As seen in FIG. 5, as the hammer 113 is released from the fully-cocked position (seen in phantom lines), the striking end 116 of the hammer will move past the at-rest position and cause the firing pin to penetrate the cylinder window 111. This in turn forces the ball of the spring guide 139 out of the receiving slot 138 and against the backstrap 102. The backstrap 102 contains the spring guide 139 and forces it back into the slot after firing.

Just below the base 129 of the hammer, the spring guide 139 narrows to form a guide shoulder 141, against which an upper end of the coil spring 137 rests. At its lower end, the coil spring 137 sits against a spring seat 143, against which the spring is compressed as the hammer 113 is cocked. The spring guide 139 passes through an aperture in the spring seat 143, and thus acts as a plunger that is coaxial to the coil spring 137, serving to always retain the spring between the guide shoulder 141 and the spring seat 143. The spring seat 143 is mounted atop a spring support arm 133, which is rigidly affixed to the grip 104 by a fastener 131 at a lower end of the spring support arm. Thus, the spring seat is rigidly retained with respect to the grip 104, and the spring operatively couples the frame of the gun with the pivoting hammer 113, to always bias it toward the cylinder-housing 103.

In addition, the hammer spring assembly 117 includes a hammer strut 144, which extends forward of the guide 139 toward a back edge 146 of the hammer. This strut 144 is an important safety mechanism, because it helps urge the hammer 113 away from the firing position (FIG. 5) and back toward the at-rest position (FIG. 3). In this position, a gap 118 is formed between the hammer 113 and the cylinder-housing 103, and the firing pin 114 is kept away from any cartridge in the firing line 115. As seen by noting the movement of the hammer guide 139 out of the receiving slot 138, illustrated in FIG. 5, release of the hammer from the fully-cocked position creates enough momentum to rock the hammer 113 forward and dislodge the spring guide 138 to a maximum extent permitted by the backstrap 102. After striking the cylinder-housing 103, the hammer 103 rocks back to the at-rest position by the action of the hammer strut 144 and the coil spring 137. In this position, if the trigger is released, the interlock 123 will be biased upward and prevent any movement of the hammer 113 toward the firing position, as will be described below.

III. The Trigger Mechanism 109.

The trigger mechanism 109 includes the hammer 113, the trigger 119, the leaf-spring 121, which biases the trigger, the interlock 123 and the cylinder latch 125, as well as two sets of shoulders 157 and 159.

Referring to FIG. 3, the hammer 113 is pivoted back against the influence of the hammer spring assembly 117 and is engaged and held there by a trigger sear 145, which is located at a top end of the trigger 119. The trigger 119 is pivotally mounted by the cylinder-housing 103 about a pivot point 147 that is just below and forward of the hammer's pivot point 127. Its rotation and bias are imparted to a trigger nose 151 which, which is urged by the leaf-spring 121 upward, to thereby bias the trigger to rotate in a counter-clockwise direction (as seen in FIG. 3). This urges the trigger sear 145 against the hammer. This bias against the trigger nose 151 also urges a finger-portion 148 of the trigger forward, into a position where it may thereafter be pulled to release the trigger sear 145 and cause the gun to fire.

The trigger sear 145 engages the cam 149 formed by the bottom edge of the hammer 113, and cannot rotate past this point. Since the cam 149 has a slightly larger radius where it contacts the trigger sear 145 in the at-rest position, the finger-portion 148 of the trigger is allowed to pivot only somewhat forward (counterclockwise), as seen in FIG. 3. As the hammer 113 is cocked, however, the radius of the cam 149 at the hammer/trigger sear interface decreases slightly, enabling the leaf-spring 121 to rotate the finger-portion 148 of the trigger slightly forward. This is indicated by reference numeral 153 in FIG. 4. At each of two points along the cam 149, the trigger sear 145 may engage the hammer and prevent its retrograde rotation to move the firing pin 114 back toward the cylinder-housing 103.

First, a half-cocked notch 154 in the cam 149 forms a lip that is adapted to receive and securely retain the trigger sear 145 during cocking. If the, hammer 113 is half-cocked, the leaf-spring 121 will rotate the trigger 119 such that manual release of the hammer will cause the trigger sear 145 to engage the lip of the half-cocked notch 154. The trigger 119, although its finger-portion 148 is somewhat extended forward as seen in FIG. 4, cannot be pulled because its trigger sear 145 cannot be disengaged from the half-cocked notch 154 (FIG. 49 unless the hammer is first further cocked to disengage the notch from the trigger sear. In this half-cocked position, the cylinder latch 125 does not stop the cylinder 105 from rotating and the gun can be loaded and unloaded.

Second, as seen in FIGS. 3–5, as the hammer 113 is fully-cocked, the trigger sear 145 will move along the cam and eventually engage a hammer sear 155. This hammer sear 155 is used to hold the hammer in a fully-cocked-position from which the gun can be fired. Since there is no lip associated with the hammer sear 155, as there was with the half-cocked notch 154, the trigger 119 may be pulled when the hammer 113 is in this position, to selectively and suddenly disengage the trigger sear 145 and the hammer sear 155. Under the influence of the powerful coil spring 137, and with the trigger sear 145 retracted from the cam 149, the hammer 113 accelerates forward to strike the cylinder-housing 103, thereby enabling firing of the revolver 101.

The trigger mechanism 109 includes a blocking mechanism that selectively blocks motion of the hammer 113 toward the at-rest position. In the preferred embodiment, this mechanism includes use of a hammer that has a specially-milled shoulder 159 at a rear portion of the cam 149. The shoulder 159 is selectively engaged by a hammer arm 165 of the interlock 123, as will be described below, to retard the hammer's rotation toward the cylinder-housing 103, and inhibit firing. If a particular model of gun does not have a hammer that already includes such a shoulder, or another object which can be employed by a trigger mechanism to impede hammer motion, then either the hammer can be milled to include the shoulder, or a replacement hammer having a shoulder can be provided as part of a trigger mechanism kit.

The cylinder-housing 103 also has two parallel frame shoulders 157 which face in generally a forward direction, opposite the hammer shoulder 159. This is indicated by the phantom line 158 in each of FIGS. 3–5 and 10, although the frame shoulders are best seen in FIGS. 7 and 9. A phantom line is used in FIGS. 3–5 because these figures show a cross-section of the revolver, and one frame shoulder 157 exists on either side of that cross-section, but are not present in it. As the revolver is fired, the hammer 113 pivots quickly forward such that its shoulder 159 also pivots rearward within the body of the revolver 101, generally toward and opposite the static frame shoulders 157. If the trigger 119 is not being pulled, the interlock 123 is pivoted upward toward the frame shoulders 157 such that, as seen in FIG. 7, the interlock's hammer arm 165 provides a bridge between the two frame shoulders 157 and blocks motion of the hammer shoulder 159, to prevent the hammer from ever reaching the firing position.

The interlock 123 is pivotally mounted by the gun frame, just laterally aside the hammer 113 and the trigger 119. In fact, as seen in FIGS. 3–5, the interlock 123 is pivotally mounted by the same pivotal mounting as mounts the cylinder latch 125. Thus, in a kit environment, the preferred embodiment permits the interlock to be easily mounted upon existing parts within the gun.

The interlock 123 provides a second interface between the hammer 113 and gun frame (the trigger 119 being the first interface), and a backup, should the trigger sear 145 accidentally slip. In fact, the interlock 123 will provide a hammer block at all times, until and unless the trigger is pulled. For example, the interlock 123 will be pivoted to its locking position should the hammer accidentally slip from a human's thumb that is cocking the hammer, or should the trigger sear 145 disengage one of the half-cocked notch 154 and the hammer sear 155, such as might happen if the gun is dropped. As another, previously-mentioned example, the interlock 123 is interposed in its locking position when the gun is at-rest, preventing bumping or striking of the hammer 113 from accidentally firing the gun when it is at-rest.

As seen in FIG. 3, the interlock 123 has an associated pivot point 163 that is located somewhat forward of the pivot point 147 of the trigger. The interlock 123 extends downward from this pivot point, and then rearward, toward the back end 129 of the hammer, where it terminates in the hammer arm 165. Further forward, near its pivot point 163, the hammer also has a trigger arm 161 that engages each of the nose 151 of the trigger and the leaf-spring 121. Thus, as can be best seen in FIG. 7, the interlock 123 lies laterally aside the trigger 119 and the hammer 113, interfacing with each using laterally-projecting arms 161 and 165 that respectively engage them.

At the trigger arm 161 of the interlock, which is located between the pivot points 147 and 163 of the trigger and interlock respectively, the leaf-spring 121 urges the trigger arm 161 to move upward between these pivot points. This urges the trigger to pivot counterclockwise and the interlock to pivot clockwise (from the perspective of FIGS, 3–5). A swinging end of the interlock 123 is thus biased upwards by the leaf-spring 121 and into*contact with the hammer, as seen in FIGS. 3 and 4. To selectively restrain the hammer 113, the hammer arm 165 is specially adapted to continually engage the shoulder 159, until and unless the trigger 119 is pulled.

As seen in FIG. 5, pulling of the trigger 119 forces the trigger arm 161 down, thereby pivoting the interlock counterclockwise and pulling its hammer arm 165 out of contact with the hammer shoulder 159 and into an unlocked state (as indicated by the arrow 167 of FIG. 5). At this time also, the trigger sear 145 is rotated away from the hammer sear 155, and the hammer 113 allowed to act under the influence of the hammer spring assembly 117. As indicated by the arrow 168 in FIG. 5, the striking end 116 of the hammer swings toward the cylinder-housing 103 with enough momentum that it will contact the cylinder-housing, notwithstanding partial shock absorption of the impact by the hammer strut 144. The hammer strut 144 temporarily displaces the spring guide 139, as indicated by the reference numeral 170 in FIG. 5. When the trigger is released, the leaf-spring 121 will again urge the interlock 123 back into the locked state, as seen in FIG. 3.

Figure 6:
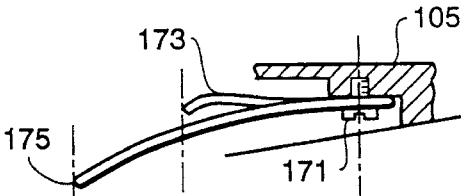
FIG. 6 is a view of a leaf-spring that separately biases both of the trigger and a cylinder latch in the revolver of FIG. 3.

The preferred leaf-spring 121 is best illustrated in FIG. 6. The spring 121 is rigidly secured at one end to the cylinder-housing 103 by a fastener 171, while it has a first finger end 175 that engages the interlock 123 (not seen in FIG. 6). A second finger end 173 of the leaf-spring is used to engage the cylinder latch 125 and thereby lock the cylinder 105 against rotation when the revolver 101 is in the at-rest or fully-cocked positions.

It can thus be seen, with reference to FIG. 3, that in implementing the preferred trigger mechanism according to the present invention, the interlock 123 may be easily retrofitted to an existing revolver 101 or other gun, and does not necessarily require special modification of the gun's trigger mechanism, unless a shoulder 159 needs to be incorporated into the hammer. The existing trigger and trigger spring of the gun may be utilized without replacement or modification.

By providing a hammer blocking mechanism, the revolver 101 preferably provides a mechanism redundant to the normal trigger mechanism for providing against accidental release of the hammer 113 when it is cocked. Furthermore, this mechanism is carried entirely within the revolver, such that it is not visible externally, and thus provides a safety device that can be advantageously used in authentic, original edition guns or their replicas.

IV. The Alternative Interlock 203 And Leaf-Spring 205.

As indicated above, the preferred embodiment uses an interlock 123 that operates as part of an additional safety mechanism, in back-up of the half-cocked notch 154 and the hammer sear 155, should the trigger sear 145 accidentally disengage either of them. However, if the interlock 123 is removed from the revolver 101, it will operate precisely as would the original, unmodified gun.

To address this situation, a contemplated alternative embodiment 201 is presented in FIGS. 8–10. A modified interlock 203 is utilized instead of the preferred interlock 123, and its presence is accompanied by replacement of the normal leaf-spring 121 (FIG. 6) with a shortened leaf-spring 205 (illustrated in FIG. 8). Using these parts, the revolver 101 cannot be cocked or moved in a normal proper manner to a safety position unless the modified interlock 203 is properly installed. This is because the shortened leaf-spring 205 prevents spring-biased operation of the trigger assembly 109 if the modified interlock 203 is removed.

As best seen in FIG. 10, the interlock 203 includes an especially-wide trigger arm 207 that, as with the preferred embodiment, engages the leaf-spring on one side of the arm and the nose 151 of the trigger on the other side of the arm. However, unlike the preferred embodiment, the shortened leaf-spring 205 does not engage the nose 151 of the trigger unless the interlock 203 is present. Removal of the modified interlock 203 prevents the bias of the shortened leaf-spring 205 from biasing the trigger 119. Hence, if the hammer 113 is manually cocked without proper installation of the modified interlock 203, the trigger sear 145 of the trigger will not be spring-biased toward the hammer and will not readily engage and retain the hammer in either of the half- or fully-cocked positions. Since the hammer 113 will not normally be held by the trigger 119 in one of these positions, the risk of unintended discharge when the hammer is safely held in the partially- or fully-cocked positions is again further reduced.

V. Implementation In A Long Gun.

FIG. 11 shows a gun trigger mechanism according to the present invention which has been applied to a long gun 301, which can be a rifle, shotgun, or other long gun. The gun trigger mechanism is different from the implementations referred to above, since a stock 303 of the long gun retains a hammer spring assembly 305 that is used to motivate the hammer 307. The hammer spring assembly 305 extends generally backward from the hammer, instead of downward and away in the manner previously described for the revolver 101.

Figure 12:
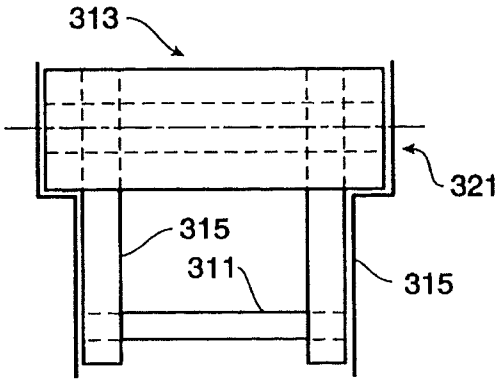
FIG. 12 is a top view of the interlock used in the long gun embodiment of FIG. 11.

The hammer 307 includes a specially-milled hammer shoulder 309 in its rear lower end 310 that is engaged by a hammer arm 311 of an interlock 313. In this implementation, the interlock 313 has two lateral sides 315 which are arranged on either side of the hammer. The hammer 307 is milled to have reduced lateral sides 317 at its lower end 310. This is also seen in FIG. 12, which is a top view of the interlock 313. That is to say, the lower end 310 of the hammer rides within the interlock 313 which swings around the hammer. A swinging end 319 of the interlock mounts the hammer arm 311 and is coupled to a pivotally mounted main portion 321. As seen in FIG. 11, as the hammer 307 is cocked, a trigger sear 323 of the trigger engages a hammer sear 325 of the hammer to retain the hammer in the fully-cocked position. If the hammer is released from this position when the trigger 327 is not pulled, the hammer arm 311 will be pivoted upward and engage the hammer shoulder 309 before a striking end 329 of the hammer moves to the firing position. As with the other embodiments already disclosed, the hammer arm 311 cooperates with a frame shoulder 331 of the stock 303 to form a rigid stop to keep the hammer 3071out of the firing position unless the trigger is concurrently being pulled. The hammer spring assembly 305 also includes a hammer strut 333 and a spring guide 335 that mounts a displaceable ball portion 337 that rides within a receiving slot of the hammer.

Having thus described several exemplary embodiments of the invention, it will be apparent that further alterations, modifications, and improvements will also occur to those skilled in the art. Such alterations, modifications, and improvements, though not expressly described or mentioned above, are nonetheless intended and implied to be within the spirit and scope of the invention. For example, the invention is not limited to a revolver implementation of the trigger mechanism, but it may include other types of guns. Similarly, the gun trigger mechanism of the present invention may be applied to double-action guns, or other guns, without departing from the spirit of the invention. Accordingly, the foregoing discussion is intended to be illustrative only; the invention is limited and defined only by the following claims and equivalents thereto.

I claim:

1. A revolver gun trigger mechanism comprising a gun frame, a trigger mounted on the frame, the trigger being pulled to fire the gun, a gun hammer movable between a fully-cocked position, from which the gun is intended to be fired by release of the gun hammer, and a firing position, the gun hammer being biased from the fully-cocked position toward the firing position, an interlock mounted on the gun frame, the interlock being movable between a locked state in which it acts to block movement of the gun hammer toward the firing position, and an unlocked state in which it does not act to block the movement of gun hammer toward the firing position, wherein the interlock is biased toward its locked state and is coupled to the trigger, such that the interlock blocks the gun hammer when it is released from reaching the firing position, unless the trigger is concurrently pulled, a means for revolving a cylinder to thereby advance a subsequent chamber, and a cylinder latch that locks a cylinder of the gun and prevents it from rotating, at least when the gun hammer is in the fully-cocked position, the cylinder latch being pivotally mounted on the frame upon a pivot pin, and the interlock is pivotally mounted on the frame upon the same pivot pin as the cylinder latch is pivotally mounted upon.

2. A gun trigger mechanism comprising a gun frame, a trigger mounted on the frame, the trigger being pulled to fire the gun, a gun hammer movable between a fully-cocked position, from which the gun is intended to be fired by release of the gun hammer, and a firing position, the gun hammer being biased from the fully-cocked position toward the firing position, an interlock mounted on the gun frame, the interlock being movable between a locked state in which it acts to block movement of the gun hammer toward the firing position, and an unlocked state in which it does not act to block the movement of gun hammer toward the firing position, wherein the interlock is biased toward its locked state and is coupled to the trigger, such that the interlock blocks the gun hammer when it is released from reaching the firing position, unless the trigger is concurrently pulled, a means for revolving a cylinder to thereby advance a subsequent chamber, a cylinder latch that locks a cylinder of the gun and prevents it from rotating, at least when the gun hammer is in the fully-cocked position, the cylinder latch being pivotally mounted on the frame upon a pivot pin, and the interlock is pivotally mounted on the frame upon the same pivot pin as the cylinder latch is pivotally mounted upon, the interlock is pivotally mounted on the gun frame and is biased to rotate in a first rotational direction, and the interlock mounts a trigger arm perpendicular to the plane of the interlock, the trigger arm adapted to engage the trigger, and a trigger-biasing spring mounted to the gun frame, the trigger-biasing spring engaging the trigger arm and thereby biasing the interlock toward the locked state, the trigger is pivotally mounted by a pivot pin on the gun frame, the trigger includes a nose that is adapted to engage the trigger arm of the interlock on a first side of the trigger arm, the first side is opposite a second side of the trigger arm that is engaged by the trigger-biasing spring, the trigger-biasing spring biases the trigger arm, to urge the interlock to pivot in a first rotational direction, and the trigger arm transfers bias to the nose of the trigger, which is thereby urged to pivot in a second rotational direction, opposite the first, the trigger-biasing spring is a leaf-spring that is mounted on the gun frame at a first end and is free at a second end, the trigger pivots about the pivot pin without the nose engaging the free end of the leaf-spring, the trigger arm above the interlock engages both of the free end of the leaf spring and the nose of the trigger, and the arm is urged into engagement with the nose by the leaf-spring.

3. A gun trigger mechanism comprising a gun frame, a trigger mounted on said gun frame, a gun hammer mounted on said gun frame and movable toward a firing position, and an interlock mounted on said gun frame, said interlock being continuously biased toward a locked state to block movement of said gun hammer toward the firing position, said interlock being movable against the bias away from the locked state when said trigger is pulled.

4. The gun trigger mechanism of claim 3, wherein said gun hammer is movable between a fully-cocked position and the firing position.

5. The gun trigger mechanism of claim 4, wherein said gun hammer is biased toward an at-rest position between the firing position and the fully-cocked position.

6. The gun trigger mechanism of claim 5, further comprising a hammer strut operably connected to said gun hammer to bias said gun hammer towards the at-rest position, the bias of said hammer strut being overcome by the momentum of said gun hammer when said gun hammer is released from the fully-cocked position under the influence of the bias of said hammer-biasing spring.

7. The gun trigger mechanism of claim 4, further comprising a hammer-biasing spring operably connected to said gun hammer to urge said gun hammer towards the firing position.

8. The gun trigger mechanism of claim 3, further comprising a cylinder rotatably mounted on said frame, said cylinder having a plurality of chambers located therein, an advancing member operably connected to said cylinder to revolve said cylinder and advance it to a subsequent chamber, and a cylinder latch operably connected to said cylinder to prevent said cylinder from rotating when said gun hammer is in a fully-cocked position, said cylinder latch and said interlock being pivotally mounted on said frame upon a pivot pin.

9. The gun trigger mechanism of claim 3, further comprising a first pivot upon which said gun hammer is mounted to said gun frame, a hammer sear formed in said gun hammer, a hammer-biasing spring operably coupled to said gun frame and said gun hammer, said hammer-biasing spring being capable of urging said gun hammer to pivotally rotate toward the firing position, a second pivot upon which said trigger is pivotally mounted to said gun frame, a trigger sear formed in said trigger, said trigger sear being adapted to engage said hammer sear to retain said hammer in a fully-cocked position, said trigger sear being disengageable from said hammer sear when said trigger is pulled to thereby releases said gun hammer, enabling said gun hammer to be urged under the influence of said hammer-biasing spring toward the firing position, and a trigger-biasing spring operably connected to said trigger, said trigger biasing spring biasing said trigger in a direction opposite the direction said trigger is pulled to withdraw said trigger sear from engagement with said hammer sear.

10. The gun trigger mechanism of claim 3, wherein said gun hammer further comprises a partially cocked position interposed between the fully-cocked and firing positions, said trigger being incapable of being pulled when said gun hammer is in the partially-cocked position.

11. The gun trigger mechanism of claim 3, further comprising a trigger-biasing spring engaging said interlock to bias said interlock toward its locked state, said interlock engages said trigger and transfers said bias of said trigger-biasing spring to said trigger.

12. The gun trigger mechanism of claim 11, wherein said trigger biasing spring terminates at a position in spaced relation with said trigger.

13. The gun trigger mechanism of claim 12, further comprising a first pivot upon which said gun hammer is mounted to said gun frame, a hammer sear formed in said gun hammer, a hammer-biasing spring operably coupled to said gun frame and said gun hammer, said hammer-biasing spring being capable of urging said gun hammer to pivotally rotate toward the firing position, a second pivot upon which said trigger is pivotally mounted to said gun frame, a trigger sear formed in said trigger, said trigger sear being adapted to engage said hammer sear to retain said hammer in a fully-cocked position, said trigger sear being disengageable from said hammer sear when said trigger is pulled to thereby releases said gun hammer, enabling said gun hammer to be urged under the influence of said hammer-biasing spring toward the firing position, and a trigger-biasing spring operably connected to said trigger, said trigger biasing spring biasing said trigger in a direction opposite the direction said trigger is pulled to withdraw said trigger sear from engagement with said hammer sear.

14. The gun trigger mechanism of claim 3, further comprising a first and second pivot pin upon which said trigger and said interlock, respectively, are pivotally mounted on said gun frame, a trigger-biasing spring mounted on said gun frame, said trigger-biasing spring biasing said interlock toward its locked state, and biasing said trigger toward a direction that is opposite the direction it may be pulled to fire a gun, and said trigger being coupled to said interlock causing said interlock to rotate in a direction against the bias of said trigger-biasing spring away from said interlock's locked state when said trigger is pulled.

15. The gun trigger mechanism of claim 3, further comprising a trigger arm extending perpendicularly from said interlock, said trigger arm being adapted to engage said trigger, and a trigger-biasing spring mounted to said gun frame, said trigger-biasing spring engaging said trigger arm and biasing said interlock toward its locked state.

16. The gun trigger mechanism of claim 15, further comprising a nose formed in said trigger and adapted to engage said trigger arm of said interlock on a first side of said trigger arm, and said trigger-biasing spring adapted to engage a second side of said trigger arm, said second side being opposite said first side of said trigger arm, said trigger arm transfers the bias from said trigger-biasing spring to said nose of said trigger.

17. The gun trigger mechanism of claim 16, wherein said trigger-biasing spring terminates at a position in spaced relation with said trigger.

18. The gun trigger mechanism of claim 16, wherein said trigger-biasing spring is a leaf spring mounted on said gun frame at a first end, a second end of said leaf spring engages said trigger arm of said interlock and urges said trigger arm of said interlock into engagement with said nose of said trigger.

19. The gun trigger mechanism of claim 3, further comprising a frame shoulder formed in said gun frame laterally adjacent to said gun hammer, and a hammer arm extending from said interlock perpendicular to said gun hammer, said interlock being interposed between said frame shoulder and said gun hammer forming a stop to block the rotation of said gun hammer toward the firing position when said interlock reaches its locked state.

20. The gun trigger mechanism of claim 3, further comprising a hammer-biasing spring operably coupled between said gun frame and said gun hammer, said hammer-biasing spring urging said gun hammer in a first direction toward the firing position, a rebound device operably connected to said gun hammer, said rebound device biasing said gun hammer in a second direction, opposite the first direction, away from the firing position toward an at-rest position, and a firing pin mounted on said gun hammer, said firing pin being held in space relation from a cartridge when said gun hammer is at the at-rest position.

21. The gun trigger mechanism of claim 20, wherein said rebound device is a hammer strut.

22. A gun trigger mechanism comprising a gun frame, a trigger mounted on said gun frame and biased toward a position at which it may be pulled against the bias by a finger of a gun operator, a gun hammer movable between a fully-cocked position and a firing position, said gun hammer being biased toward an at-rest position interposing the fully-cooked and firing positions, a hammer sear formed in said gun hammer, a trigger sear formed in said trigger, said trigger sear being urged by the bias on said trigger to engage said hammer sear when said gun hammer is in the fully-cocked position, and a blocking device biased at all times to block movement of said gun hammer from the fully-cocked position, the at-rest position or any position therebetween, past the at-rest position to prevent said gun hammer from reaching the firing position unless said trigger is being concurrently pulled.

23. The gun trigger mechanism of claim 22, further comprising a spring that biases said trigger in a direction opposite the direction said trigger is pulled to fire the gun, said spring terminating at a position in space relation with said trigger, and an engaging member on said blocking device, said engaging member engaging both said spring and said trigger thereby transferring the bias of said spring to said trigger.

24. A gun trigger mechanism comprising a gun frame having a frame shoulder, a gun hammer movable between a fully-cocked position and a firing position and being pivotally mounted on said gun frame, a hammer shoulder formed in said gun hammer, said hammer shoulder movable toward said frame shoulder when said gun hammer moves toward the firing position, said hammer shoulder opposing said frame shoulder, and an interlock movable between a locked state at which it cooperates with said frame shoulder forming a stop that blocks movement of said hammer shoulder thereby preventing said gun hammer from moving toward said firing position, and an unlocked state at which it does not block said hammer from moving toward said firing position, said interlock being continuously biased toward the locked state and being coupled to a trigger and movable by said trigger against the bias and towards the unlocked state when the trigger is pulled.

25. The gun trigger mechanism comprising a gun frame, a gun hammer pivotally mounted on said gun frame and movable between a fully-cocked position and a firing position, said gun hammer being biased from the fully-cocked position toward the firing position, a trigger operably connected to said gun hammer, a rebound device operably connected to said hammer to urge said hammer away from the firing position towards an at-rest position, and an interlock mounted on said frame and continuously biased toward a locked state at which it blocks movement of said gun hammer past the at-rest position when said gun hammer is moved from the fully-cocked position, the at-rest position or any, position therebetween, towards the firing position unless the trigger is being concurrently pulled.

26. A firing interlock for a gun comprising a body having a first end and a second end, said body being adapted to mount on a frame of a gun adjacent a trigger and a hammer of the gun, a pivot formed in said body adjacent said first end, a hammer arm extending from said body adjacent said second end, said hammer arm being adapted to interpose the frame and the hammer of the gun when biased to a locked state, and a trigger arm extending from said body interposed between said pivot and said hammer arm, said trigger arm being adapted to engage a trigger-biasing spring and the trigger of the gun, and transfer the bias of said trigger-biasing spring to the trigger.

27. A gun trigger mechanism comprising a gun frame, a trigger mounted on said gun frame, a gun hammer mounted on said gun frame and movable toward a firing position, an interlock mounted on said gun frame, said interlock being biased toward a locked state to block movement of said gun hammer toward the firing position, said interlock being movable against the bias away from the locked state when said trigger is pulled, and a trigger-biasing spring engaging said interlock to bias said interlock toward its locked state, said interlock engages said trigger and transfers said bias of said trigger-biasing spring to said trigger, said trigger biasing spring terminates at a position in spaced relation with said trigger.

28. A gun trigger mechanism comprising a gun frame, a trigger mounted on said gun frame, a gun hammer mounted on said gun frame and movable toward a firing position, an interlock mounted on said gun frame, said interlock being biased toward a locked state to block movement of said gun hammer toward the firing position, said interlock being movable against the bias away from the locked state when said trigger is pulled, a trigger arm extending perpendicularly from said interlock, said trigger arm being adapted to engage said trigger, and a trigger-biasing spring mounted to said gun frame, said trigger-biasing spring engaging said trigger arm and biasing said interlock toward its locked state, and said trigger arm transferring the bias of said trigger-biasing spring to the trigger.

29. A gun trigger mechanism comprising a gun frame, a trigger mounted on said gun frame, a gun hammer mounted on said gun frame and movable toward a firing position, an interlock mounted on said gun frame, said interlock being biased toward a locked state to block movement of said gun hammer toward the firing position, said interlock being movable against the bias away from the locked state when said trigger is pulled, a trigger arm extending perpendicularly from said interlock, said trigger arm being adapted to engage said trigger, a trigger-biasing spring mounted to said gun frame, said trigger-biasing spring engaging said trigger arm and biasing said interlock toward its locked state, a nose formed in said trigger and adapted to engage said trigger arm of said interlock on a first side of said trigger arm, and said trigger-biasing spring adapted to engage a second side of said trigger arm, said second side being opposite said first side of said trigger arm, said trigger arm transfers the bias from said trigger-biasing spring to said nose of said trigger.

30. The gun trigger mechanism of claim 29, wherein said trigger-biasing spring terminates at a position in spaced relation with said trigger.

31. The gun trigger mechanism of claim 29, wherein said trigger-biasing spring is a leaf spring mounted on said gun frame at a first end, a second end of said leaf spring engages said trigger arm of said interlock and urges said trigger arm of said interlock into engagement with said nose of said trigger.

32. A gun trigger mechanism comprising a gun frame, a trigger mounted on said gun frame and biased toward a position at which it may be pulled against the bias by a finger of a gun operator, a gun hammer movable between a fully-cocked position and a firing position, said gun hammer being biased toward an at-rest position interposing the fully-cocked and firing positions, a hammer sear formed in said gun hammer, a trigger sear formed in said trigger, said trigger sear being urged by the bias on said trigger to engage said hammer sear when said gun hammer is in the fully-cocked position, a blocking device biased to block movement of said gun hammer past the at-rest position to prevent said gun hammer from reaching the firing position unless said trigger is being concurrently pulled, a spring that biases said trigger in a direction opposite the direction said trigger is pulled to fire the gun, said spring terminating at a position in space relation with said trigger, and an engaging member on said blocking device, said engaging member engaging both said spring and said trigger thereby transferring the bias of said spring to said trigger.

* * * * *

UNITED STATES PATENT AND TRADEMARK OFFICE

CERTIFICATE OF CORRECTION

PATENT NO. : 5,548,914

DATED : August 27, 1996

INVENTOR(S) : David B. Anderson

It is certified that error appears in the above-indentified patent and that said Letters Patent is hereby corrected as shown below:

Column 2, line 12, delete "an" and substitute --a-- therefor.

Column 2, line 30, after "recess" insert --49--; after "hammer" insert --13--.

Column 4, line 11, change "Sears" to --sears--.

Column 5, line 55, change "an" to --and--.

Column 6, line 41, change "20L" to --201--.

Column 8, line 3, change "hammer" to --spring--.

Column 8, line 6, change "138" to --139--.

Column 8, line 8, after "hammer" change "103" to --113--.

Column 8, line 26, delete the first occurrence of "which,".

Column 8, line 49, after "if" change "the," to --the--.

Column 8, line 56, change "49" to --4)--.

Column 9, line 54, after "disengage" delete "one of".

Column 9, line 66, change "hammer" to --interlock 123--.

Column 10, line 12, after "into" delete the asterisk.

Column 10, line 49, change "trigger " to --leaf---.

Column 11, line 60, change "3071" to --307 --.

Column 14, line 24, change "releases" to --release--.

Column 14, line 61, change "releases" to --release--.

Column 16, line 27, change "space" to --spaced--.

Column 16, line 55, change "The" to --A--; after the word "comprising", begin a new subparagraph with "a gun frame".

UNITED STATES PATENT AND TRADEMARK OFFICE

CERTIFICATE OF CORRECTION

PATENT NO. : 5,548,914

DATED : August 27, 1996

INVENTOR(S) : David B. Anderson

It is certified that error appears in the above-indentified patent and that said Letters Patent is hereby corrected as shown below:

Column 17, line 2, change "any," to --any--.

Signed and Sealed this

Twenty-fifth Day of February, 1997

*Attest:*

Bruce Lehman

BRUCE LEHMAN

*Attesting Officer*

*Commissioner of Patents and Trademarks*